US010209046B2

(12) United States Patent
Loughnane

(10) Patent No.: US 10,209,046 B2
(45) Date of Patent: Feb. 19, 2019

(54) EMPTY SHOTGUN CARTRIDGE SEPARATING SYSTEM

(71) Applicant: Stephen Loughnane, County Galway (IE)

(72) Inventor: Stephen Loughnane, County Galway (IE)

( * ) Notice: Subject to any disclaimer, the term of this patent is extended or adjusted under 35 U.S.C. 154(b) by 0 days.

(21) Appl. No.: 15/571,669

(22) PCT Filed: May 9, 2016

(86) PCT No.: PCT/EP2016/060341

§ 371 (c)(1),
(2) Date: Nov. 3, 2017

(87) PCT Pub. No.: WO2016/177909

PCT Pub. Date: Nov. 10, 2016

(65) Prior Publication Data

US 2018/0149455 A1 May 31, 2018

(30) Foreign Application Priority Data

May 7, 2015 (IE) ..... 2015/0142

(51) Int. Cl.
*F42B 33/06* (2006.01)

(52) U.S. Cl.
CPC ..... *F42B 33/06* (2013.01)

(58) Field of Classification Search
CPC ..... F42B 33/06
USPC ..... 86/49
See application file for complete search history.

(56) References Cited

U.S. PATENT DOCUMENTS 3,056,191 A * 10/1962 Felmet ..... B21D 28/34 279/53
3,898,908 A * 8/1975 Isenhower ..... F42B 33/06 269/239
4,441,400 A * 4/1984 Sexton ..... F42B 33/06 30/90.1

(Continued)

FOREIGN PATENT DOCUMENTS

DE 29601851 U1 3/1996
WO 2008084463 A1 7/2008
WO 2011059357 A1 5/2011

OTHER PUBLICATIONS

International Search Report and Written Opinion dated Jul. 12, 2016, for corresponding International Application No. PCT/EP2016/060341; International Filing Date: May 9, 2016 consisting of 8-pages.

*Primary Examiner* — Bret Hayes
(74) *Attorney, Agent, or Firm* — Christopher & Weisberg, P.A.

(57) ABSTRACT

The present invention provides a system for separating empty or used ammunition cartridges, in particular spent plastic shotgun shells, in order to allow the plastic and metal component parts of the cartridge to be recycled, the system comprising a restraint which defines a guideway within which the metal head of the cartridge may be slidingly engaged, and a clamp in the form of a pair of chains arranged to define a clamping path between opposed portions of the chains and along which clamping path the case may be drawn, the guideway diverging from the clamping path so as to draw the case out of register with the head as the cart ridge is displace along the clamping path.

16 Claims, 5 Drawing Sheets

(56) References Cited

U.S. PATENT DOCUMENTS

D289,316 S * 4/1987 Kirsch ..... D22/199
9,709,369 B2 * 7/2017 Rami Porte ..... F42B 33/06

* cited by examiner

EMPTY SHOTGUN CARTRIDGE SEPARATING SYSTEM

CROSS-REFERENCE TO RELATED APPLICATIONS

This application is a Submission under 35 U.S.C. § 371 for U.S. National Stage Patent Application of, and claims priority to, International Application Number PCT/EP2016/060341 entitled AN EMPTY SHOTGUN CARTRIDGE SEPARATING SYSTEM, filed May 9, 2016, which is related to and claims priority to Ireland Patent Number 2015/0142, filed May 7, 2015, the entirety of all of which are incorporated herein by reference.

FIELD OF THE INVENTION

This invention relates to a system for separating empty or used ammunition cartridge, in particular spent plastic shotgun shells, in order to allow the plastic and metal component parts of the cartridge to be recycled.

BACKGROUND OF THE INVENTION

Millions of spent shotgun cartridges accumulate each week at gun clubs, shooting centres and clay pigeon shoots and this represent a major environmental hazard as the cartridges cannot easily be recycled, as they comprise both metal and plastic parts. There are no devices currently available to enable the plastic and metal parts to be separated for recycling purposes.

It is therefore an object of the present invention to provide a solution to the above mentioned problem.

SUMMARY OF THE INVENTION

According to the present invention there is provided an empty shotgun cartridge separating system for separating a case from a head of the cartridge, the system comprising a restraint operable to engage the head; and a clamp operable to grip the case and draw the case out of register with the head.

Preferably, the clamp and the restraint are adapted to simultaneously receive multiple cartridges for separation.

Preferably, the restraint defines a guideway within which the head may be captured, the system being operable to effect relative movement between the clamp and the guideway.

Preferably, the clamp is operable, while gripping the case, to displace the case relative to the restraint in order to displace the head along the guideway, the guideway diverging from the clamp in a direction in which the cartridge is conveyed by the clamp.

Preferably, the clamp is operable to displace the case along a first plane and the guideway extends along a second plane inclined relative to the first plane.

Preferably, the clamp comprises an opposed pair of endless surfaces between which the case may be clamped.

Preferably, the pair of endless surfaces define a clamping path having an entrance at which the endless surfaces converge and an exit at which the endless surfaces diverge.

Preferably, each of the endless surfaces is defined by a chain.

Preferably, the pair of endless surfaces comprise meshing projections.

Preferably, the pair of endless surfaces comprise teeth for gripping the case.

Preferably, the guideway extends parallel to the clamping path.

Preferably, the separating system comprises a feeding mechanism operable to deliver cartridges to the clamp.

Preferably, the feeding mechanism comprises a magnetic conveyor.

Preferably, the feeding mechanism comprises a sorting apparatus operable to arrange cartridges in a particular orientation.

Preferably, the separating system comprises a guide assembly operable to guide a cartridge into the clamp.

Preferably, the guide assembly comprises a pair of opposed rotatable circular arrays of guide members located about the clamp.

Preferably, the relative positions of the clamp and restraint may be varied in order to accommodate cartridges of different dimensions.

Preferably, the restraint has adjustable geometry in order to accommodate cartridges of different dimensions.

BRIEF DESCRIPTION OF THE DRAWINGS

The present invention will now be described with reference to the accompanying drawings, in which.

DETAILED DESCRIPTION OF THE DRAWINGS

Figure 1:
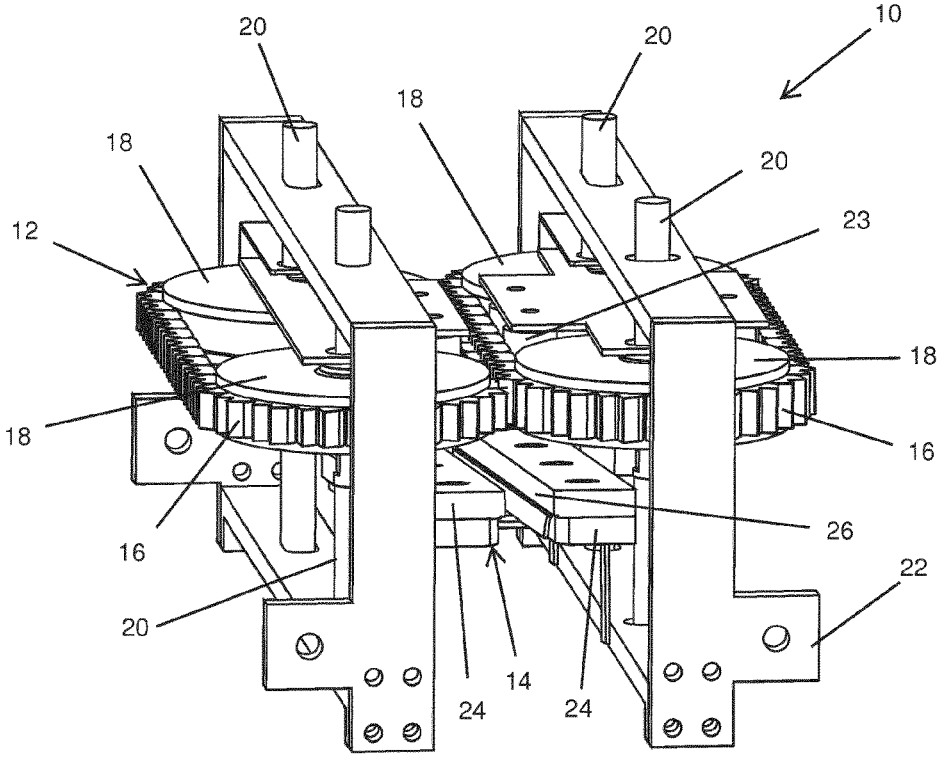
FIG. 1 illustrates a front perspective view of an empty shotgun cartridge separating system according to an embodiment of the present invention.
Figure 2:
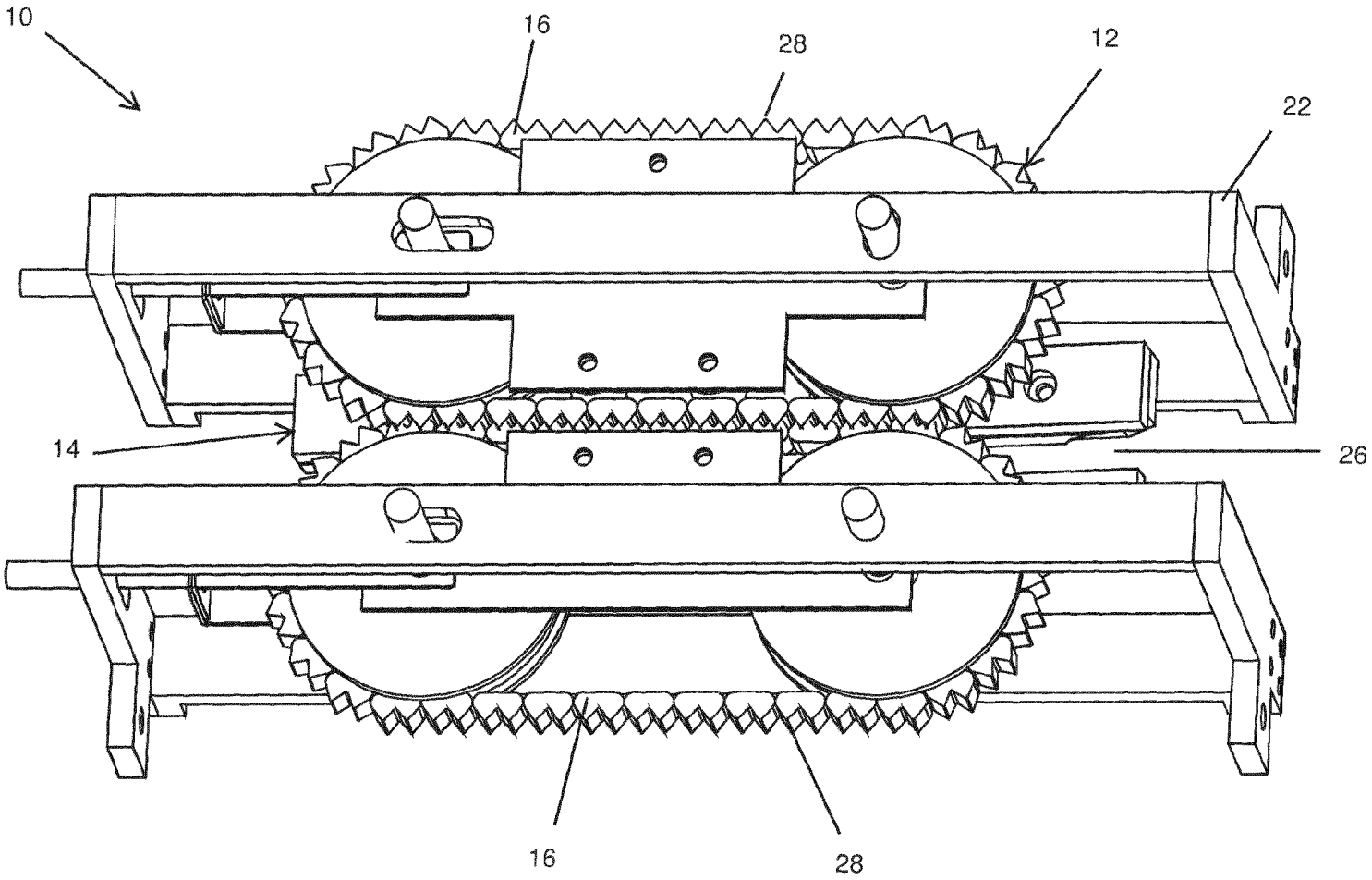
FIG. 2 illustrates a perspective view from above of the separating system shown in FIG. 1.

Referring now to the accompanying drawings there is illustrated an empty shotgun cartridge separating system according to an embodiment of the present invention, generally indicated as (10) and which is designed to allow a spent shotgun cartridge (not shown) to be separated into the upper plastic case and the lower metal head, which separated components can then be recycled. The system (10) comprises a clamp (12) which is operable, as described in detail hereinafter, to grip the plastic case of an empty shotgun cartridge, and a restraint (14) operable to engage the metal head of the cartridge, the clamp (12) being operable to displace the case relative to the restraint (14), which displacement, as described hereinafter, effects the separation of the plastic case from the metal head of the cartridge. The system (10) is also designed to allow the continuous or non discrete processing of multiple cartridges simultaneously in order to enable a high volume of cartridges to be separated and thus recycled.

The clamp (12) comprises a pair of chains (16) each arranged as a closed loop and which each therefore define an endless surface, the pair of endless surfaces facing one another along a portion of their path, and between which the case of the cartridge may be captured in order to grip the case and displace it along the path defined by the opposing portions of the chains (16). The chains (16) are driven such that the portions facing one another and which define the clamping region are driven in the same direction. It will be appreciated that any functional alternative to the chains (16) may be employed, for example belts (not shown) or the like.

Each chain (16) is mounted between a pair of pulleys (18) which may be driven by any suitable means, for example one or more electric motors (not shown) arranged to supply drive to one or more shafts (20) on which the pulleys (18) are each mounted. It will of course be appreciated that any other suitable drive means may be employed and that any other suitable arrangement may be used to configure the chains (16) to define the clamping region or path therebetween. The pair of chains (16) are driven such that they are travelling in the same direction along that portion at which the chains (16) converge and mesh with one another as hereinafter described. The pulleys (18) and shafts (20) are captured within a frame (22) which may form part of a larger structure embodying the separating system (10), and which may for example incorporate a number of additional conventional components, for example the aforementioned motor or motors and associated control equipment, in addition to sorting and feeding apparatus (not shown) which may form part of the separating system (10) as will be described hereinafter.

The particular arrangement of the chains (16) define a clamping path as mentioned above and having an entrance at which the chains (16) converge and an exit at which the chains (16) diverge, allowing a cartridge to be presented at the entrance to the clamping path where it will be drawn between the pair of chains (16) by virtue of the converging motion of the opposing chains (16) on the pulleys (18), causing the casing to be compressed or flattened and gripped by and between the pair of chains (16) to travel along the clamping path. The cartridge is intended to be presented in an orientation in which a longitudinal axis of the cartridge lies substantially parallel with a longitudinal axis of the shafts (20), which in use is most likely to be in a vertical orientation.

Any suitable arrangement may be employed in order to ensure that the chains remain in register or close proximity to one another along the length of each chain (16) which at any given time defines the clamping region. In the embodiment illustrated a number of rollers (23) are positioned adjacent each of the chains (16) in order to hold the chains (16) in position such as to ensure that the chains (16) retain a clamping force on the shotgun case located therebetween and for the full length of the clamping path defined between the chains (16). In addition to the rollers (23) the separating system (10) may incorporate one or more tensioners (not shown) in order to maintain a working tension in each of the chains (16). Such tensioners (not shown) are commonly found on mechanism employing chains and thus no further description of the configuration and operation of same is deemed necessary.

Located directly beneath and substantially parallel to the clamping path defined by the pair of chains (16) is the restraint (14). The restraint (14) comprises a pair of elongate plates (24) which are in parallel spaced relationship to one another such as to define a guideway (26) therebetween. The guideway (26) is dimensioned to receive the head of the cartridge therein, and in particular is dimensioned such that an circumferentially extending lip or rim formed on the head is seated beneath the guideway (26) and thus abutting against the underside of the pair of plates (24), thereby preventing the head from being drawn upwardly through the guideway (26) as defined by the gap between the plates (24). The restraint (14) thus enables the head of the cartridge to undergo linear displacement along the guideway (26) but is constrained vertically or axially with respect to the shotgun cartridge itself, by virtue of the edges of the opposed plates (24) contacting and bearing against the circumferential lip or rim on the head of the cartridge.

Figure 3:
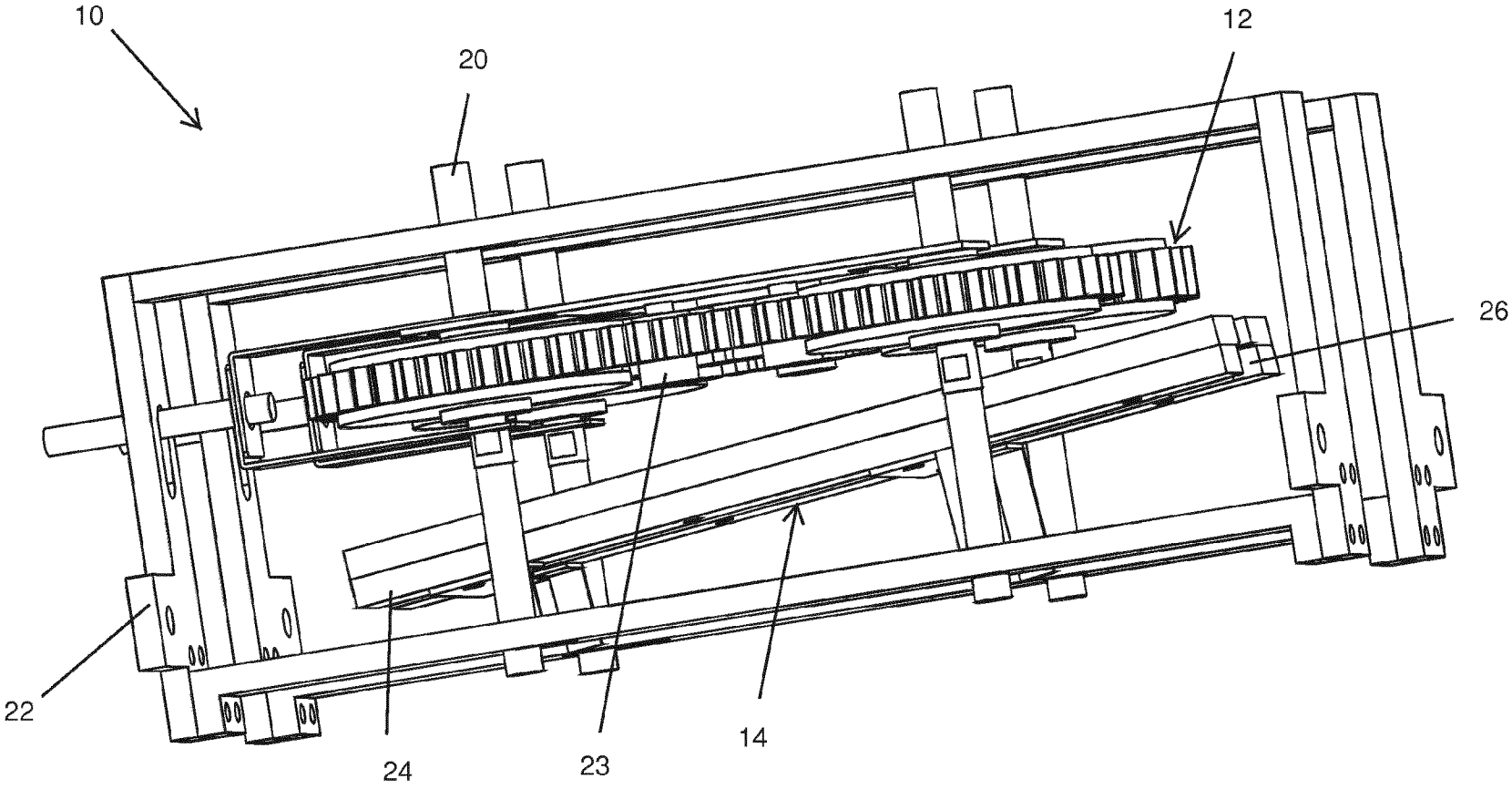
FIG. 3 illustrates a perspective view from the side of the separating system illustrated in FIGS. 1 and 2.
Figure 4:
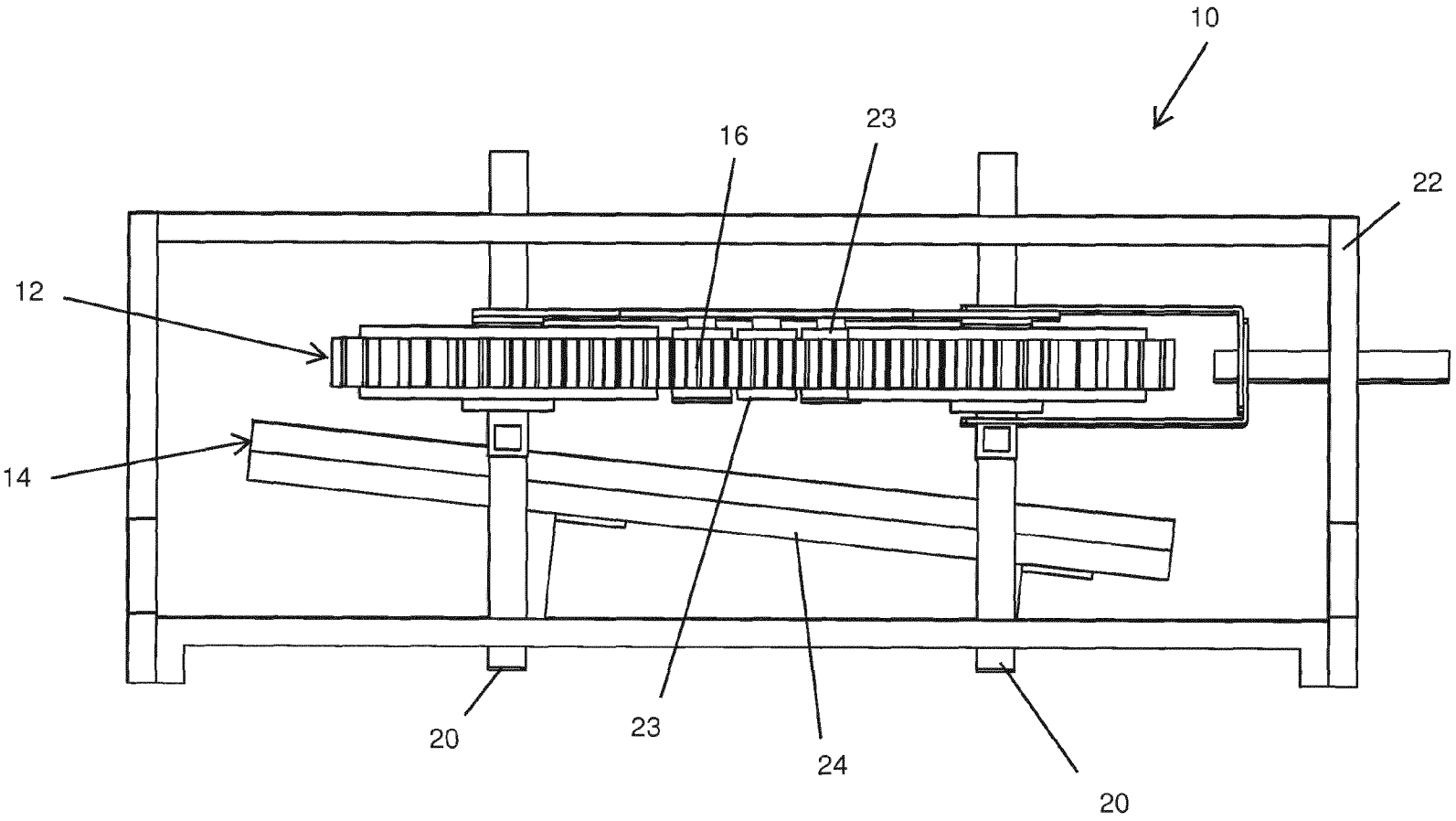
FIG. 4 illustrates a side elevation of the separating system.
Figure 5:
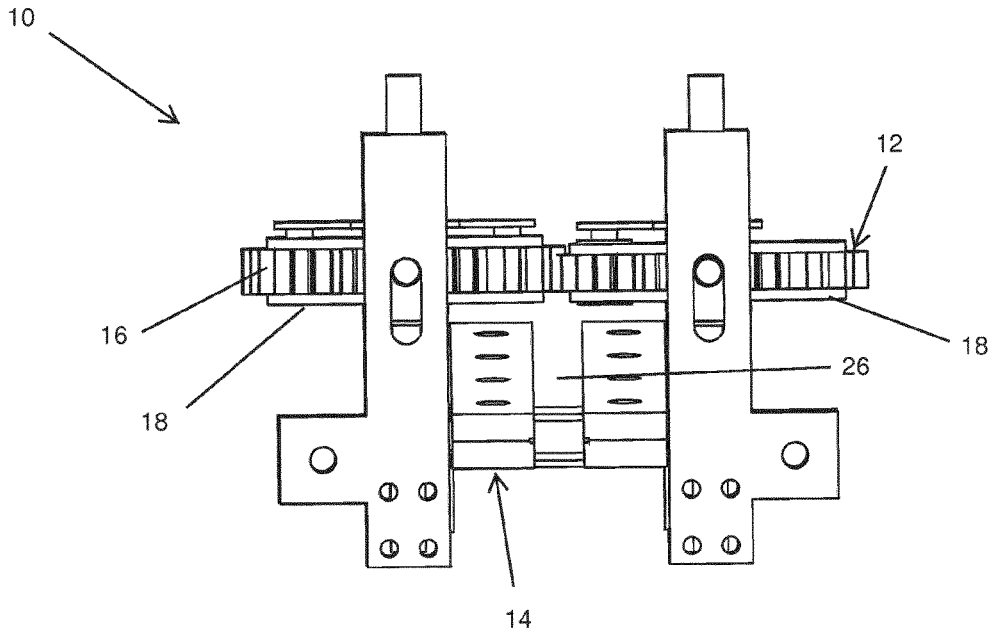
FIG. 5 illustrates a rear elevation of the separating system according to the embodiment of the present invention.

While the restraint (14), or more particularly the guideway (26) defined by the restraint (14), runs parallel to the clamping path defined between the pair of chains (16) in a first plane, which in use is a vertical plane, the guideway (26) also diverges from the clamping path between the entrance and the exit of the clamping path, in a second plane, which in use is a horizontal plane. This is most clearly visible in FIGS. 3 and 4 in which it can be seen that the pair of plates (24) of the restraint (14) slope downwardly with respect to the pair of chains (16).

Thus in use an empty shotgun cartridge is advanced towards the entrance to the clamping path between the pair of chains (16) such that the head of the cartridge enters the guideway (26) with the circumferential lip located beneath the underside of the pair of plates (24). In the embodiment illustrated, again as most clearly visible in FIGS. 3 and 4, the restraint (14) extends a small distance upstream of the forward pulleys (18) and the pair of chains (16), in order to allow the head of the cartridge to be captured within the guideway (26) before the plastic case of the cartridge reaches the entrance to the clamping path defined between the pair of chains (16).

In order to allow the pair of chains (16) to grip the plastic case of a shotgun cartridge with sufficient force to allow the head to be pulled away from the case, the pair of chains (16) preferably comprise meshing projections in the form of teeth (28) which mesh or interlock with one another along the clamping path, and will thus bite into and so effectively grip the plastic case of the shotgun cartridge therebetween. Any other suitable surface modifications may be made to the chains (16) or other alternatives such as belts or the like, in order to provide this gripping functionality.

Once the case reaches the entrance to the clamping path and is compressed and clamped between the pair of chains (16) the motion of the chains (16) will then draw the cartridge along the clamping path, with the head thus being drawn along the guideway (26). However as the guideway (26) diverges downwardly away from the clamping path as the cartridge is advanced the head will experience a force having a component perpendicular to the clamping path which will thus act to draw the head away from the plastic case, and thus ultimately the head will be separated from the case. The restraint (14) is arranged and dimensioned such that this separation occurs before the empty case reaches the end of the clamping path.

Once separated the head is free to fall away from beneath the underside of the restraint (14) where it may be collected, for example in a hopper or any other suitable means, which may or may not be mounted directly to the frame (22). Similarly once the now separated plastic case reaches the end of the clamping path at which the two chains (16) diverge it will be released and can again fall into a separate collection vessel (not shown) which may again be an integral component of the separation system (10) and may be mounted to the frame (22). The empty cases may accumulate in the collection vessel (not shown) or may be actively conveyed away to a separate storage location. As the plastic and metal components of the shotgun cartridge are now separated they may be individually recycled or otherwise reused.

The separation system (10) may additionally comprise a feeding mechanism (not shown) of conventional form and operable to continuously feed empty cartridges to the clamp (12), in particular delivering the cartridges into the guideway (26) and projecting a sufficient height upwardly out of the guideway (26) such that the plastic case can be engaged by the clamp (12). The feeding mechanism (not shown) may comprise a conveyor belt (not shown) which extends beneath the forward end of the restraint (14) and terminates at or adjacent the entrance to the clamping path defined between the pair of chains (16). The conveyor belt (not shown) may comprise a magnetic component in order to actively retain the cartridges thereon until they are engaged by the clamp (12). Alternative arrangements may be employed to secure the cartridges to the conveyor belt (not shown) and for example individual recesses or sockets (not shown) may be provided on the upper surface of the belt and which are shaped and dimensioned to at least partially receive the head of the cartridge therein.

It will therefore be appreciated that the cartridges must be deposited onto the conveyor belt (not shown) with the head of the cartridge sitting directly on the conveyor belt and the plastic casing projecting upwardly. The feeding mechanism (not shown) may therefore additionally comprise a sorting apparatus (not shown) which is operable to orient the cartridges with the head facing downwardly for deposit onto the conveyor belt. Such sorting apparatus (not shown) are well known, and may for example comprise a vibrating/rotating hopper which correctly orients the cartridge as it migrates downwardly towards a base of the hopper, from where it may be dispensed onto the conveyor belt, or indeed any other suitable conveying system (not shown). As a result no further description of the configuration and operation of the sorting apparatus (not shown) is therefore deemed necessary.

To further improve the throughput of the separating system (10) a guide assembly (not shown) may be provided in order to assist in the actively conveying the cartridge into the clamping path between the pair of chains (16). In one embodiment the guide assembly (not shown) may comprise a circular array of guide members such as spokes mounted to each of the forward shafts (20), preferably directly beneath the respective pulley (18), the spokes being dimensioned to extend slightly beyond the combined radius of the chain (16) and pulley (18). In this way as the shaft (20) is rotated in order to drive the respective chain (16), the circular array of spokes (not shown) will also rotate beneath the pair of front pulleys (18), thereby engaging the cartridge at a position slightly upstream of the entrance to the clamping path, and will thus urge the cartridge towards and into the clamping path between the pair of chains (16).

It will of course be appreciated that the guide assembly (not shown) may be of any other suitable arrangement which achieves the above mentioned functionality of guiding the cartridge towards the entrance to the clamping path and preferably actively conveying the cartridge into the clamping path. In order to reduce complexity it is however advantageous to have the guide assembly (not shown) driven by the forward shafts (20).

It will also be appreciated that in order to accommodate shotgun cartridges of different dimensions, the various components of the separating system (10) may be adjustable in order to accommodate these different sized cartridges. For example the relative positions of the chains (16) and restraint (14) may be adjusted, for example by adjusting the location of the pulleys (18) on the respective shafts (20) so to adjust the distance between the guideway (26) and the clamping path. Similarly the dimensions of the guideway (26) may be variable in order to accommodate shotgun cartridges having heads of different dimensions. Thus the distance between the pair of plates (24) may be adjustable in order to increase or decrease the width of the guideway (26). Any other suitable adjustments to the components of the separating system (10) may also be incorporated as necessary.

The separating system (10) of the present invention thus provides a means by which the plastic and metal components of an empty shotgun cartridge can be separated in order to allow at least the plastic case to be recycled. The use of the pair of opposed endless surfaces as defined by the chains (16) enables the continuous operation of the separating system (10) and allows multiple cartridges to be processed simultaneously, in order to achieve a sufficiently high output to ensure that the process is commercially viable. In addition, by utilising a conventional sorting/orienting mechanism and conveyor it is possible to essentially fully automate the process.

The invention claimed is:

1. An empty shotgun cartridge separating system for separating a case from a head of the cartridge, the system comprising:

a restraint operable to engage the head; and a clamp operable to grip the case and draw the case out of register with the head, the restraint defining a guideway within which the head is capturable, the clamp being operable, while gripping the case, to displace the case relative to the restraint in order to displace the head along the guideway, the guideway diverging from the clamp in a direction in which the cartridge is conveyed by the clamp.

2. The separating system of claim 1, wherein the clamp and the restraint are adapted to simultaneously receive multiple cartridges for separation.

3. The separating system of claim 1, wherein the clamp is operable to convey the case along a first plane and the guideway extends along a second plane inclined relative to the first plane.

4. The separating system of claim 1, wherein the clamp further comprises an opposed pair of endless surfaces between which the case is clampable.

5. The separating system of claim 4, wherein the pair of endless surfaces define a clamping path having an entrance at which the endless surfaces converge and an exit at which the endless surfaces diverge.

6. The separating system of claim 5, wherein the pair of endless surfaces further comprise meshing projections.

7. The separating system of claim 5, wherein the pair of endless surfaces further comprise teeth for gripping the case.

8. The separating system of claim 5, wherein the guideway extends parallel to the path along which the clamp conveys the case.

9. The separating system of claim 4, wherein each of the endless surfaces is defined by a chain.

10. The separating system of claim 1, further comprising a feeding mechanism operable to deliver cartridges to the clamp.

11. The separating system of claim 10, wherein the feeding mechanism further comprises a magnetic conveyor.

12. The separating system of claim 10, wherein the feeding mechanism further comprises a sorting apparatus operable to arrange cartridges in a particular orientation.

13. The separating system of claim 1, further comprising a guide assembly operable to guide a cartridge into the clamp.

14. The separating system of claim 13, wherein the guide assembly further comprises a pair of opposed rotatable circular arrays of guide members located about the clamp.

15. The separating system of claim 1, wherein the relative positions of the clamp and restraint is variable in order to accommodate cartridges of different dimensions.

16. The separating system of claim 1, wherein the restraint has adjustable geometry in order to accommodate cartridges of different dimensions.

* * * * *